United States Patent [19]

Murata

[11] 4,051,764

[45] Oct. 4, 1977

[54] HYDRAULIC ACTUATING SYSTEM

[76] Inventor: Hikaru Murata, No. 1734, Sakakura, Sakahogi-cho, Kamo, Gifu, Japan

[21] Appl. No.: 583,874

[22] Filed: June 5, 1975

[51] Int. Cl.[2] ..... F15B 13/042

[52] U.S. Cl. ..... 91/29; 91/420; 91/451; 137/106; 137/110

[58] Field of Search ..... 91/420, 451, 447, 443, 91/463, 6, 28, 29; 137/106, 110

[56] References Cited

U.S. PATENT DOCUMENTS 3,158,167 11/1964 Redelman et al. ..... 137/106

*Primary Examiner*—Irwin C. Cohen
*Attorney, Agent, or Firm*—Saul Jecies

[57] ABSTRACT

In order to automatically switch an open circuit type hydraulic actuating circuit to the meter-in flow control system when the direction of the load is positive or to the meter-out control system when the direction of the load is negative or is reversed to negative, thereby controlling the speed of the load, there is provided a hydraulic actuating system in which an amplifier valve assembly of the type which may produce a main flow whose flow rate is amplified with respect to that of a pilot flow in proportion to the ratio of the opening area of a detector orifice inserted in a pilot flow passage to the opening area of a main orifice inserted in a main flow passage, is hydraulically and operatively combined with a meter-in flow control valve for controlling the flow rate of the pilot supply flow in the amplifier valve assembly, a meter-out flow control valve for controlling the flow rate of the pilot return flow, and a switching valve inserted between the pilot supply and return flow passages and adapted to be shifted automatically in response to the pressure difference in the pilot supply and return flow passages in such a manner that one pilot flow passage having a lower pressure than the other pilot flow passage may be communicated through a low-pressure relief valve with a tank.

4 Claims, 19 Drawing Figures

20
41
25
42
37
38
36
39
27
28
40
22
34
35
32
33
L
R
26
31
24
29
30
23
21
22
101
57
59
24
102
23
21
22

L
126
R
20a
131
107
127
128
130
134
132
133
135
129
106
130
139
136
128
105
64
67
65
68
66
43
95
94
90
90
59
99
55
93
93
100
57
54
48
49
96
97
78
25
79
103
41
42
104

FIG.6
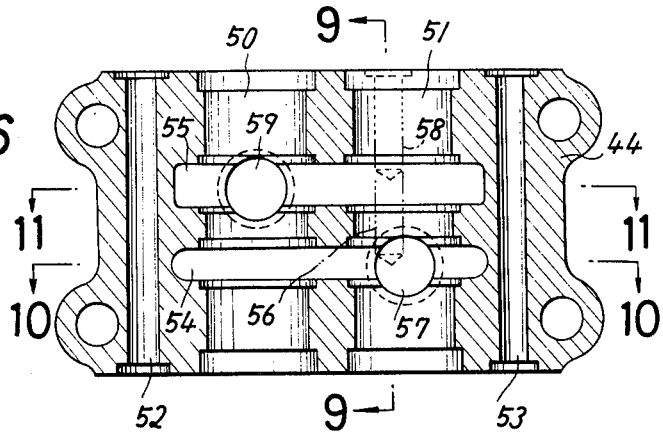
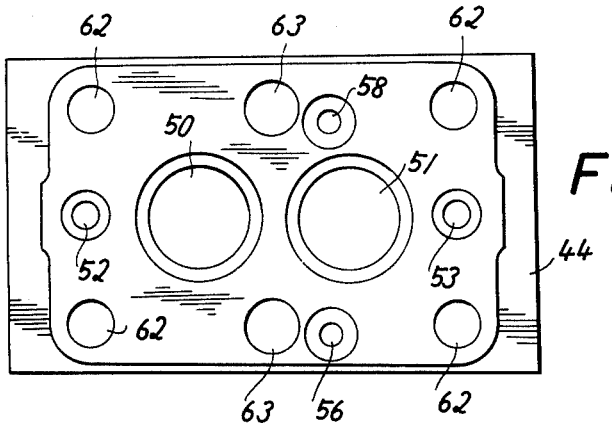
FIG.7
FIG.8
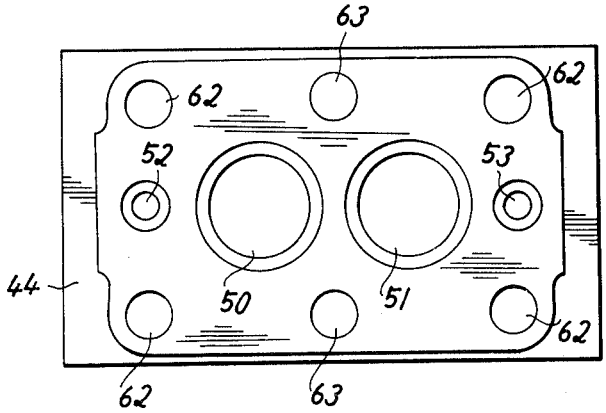

FIG. 9
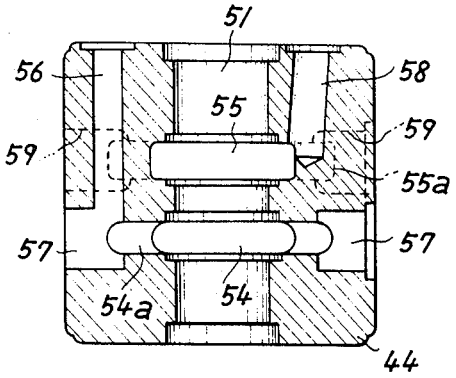
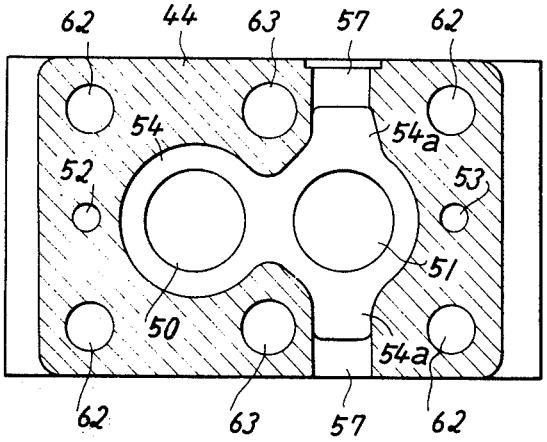
FIG. 10
FIG. 11
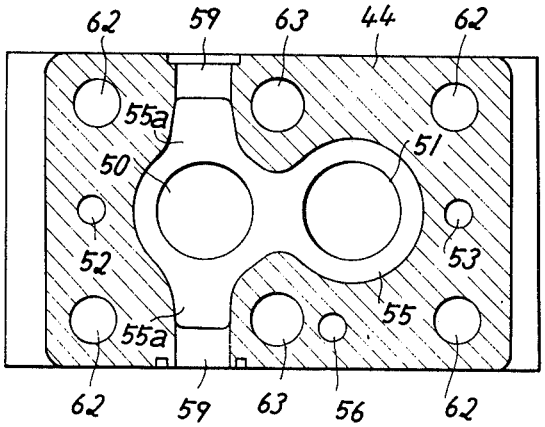

FIG.12
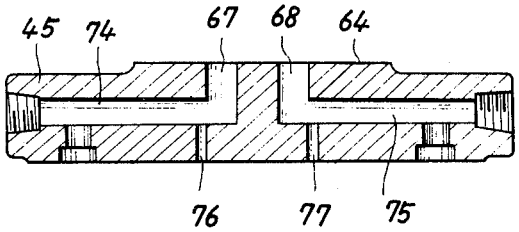
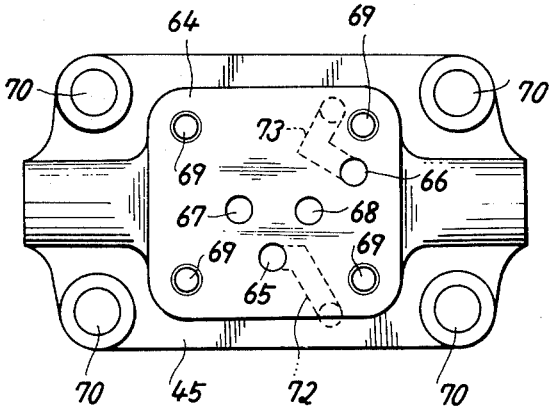
FIG.13
FIG.14
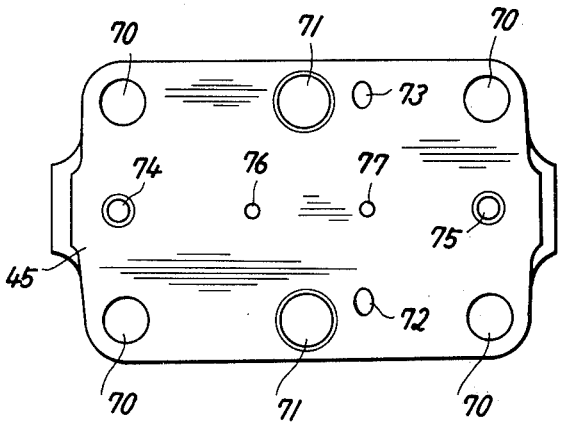
FIG.15
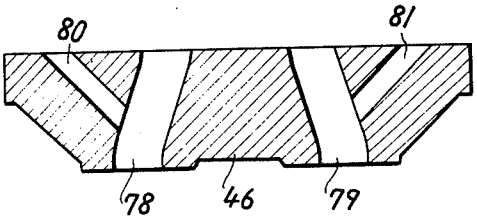

FIG.16
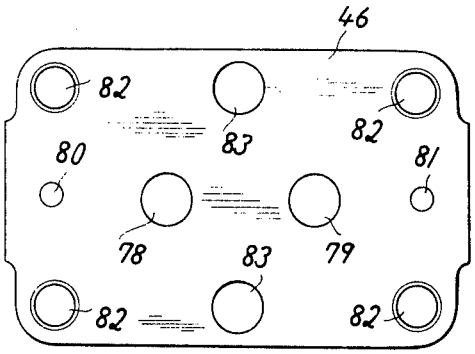
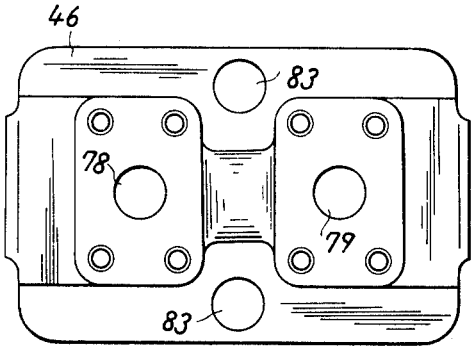
FIG.17
FIG.18
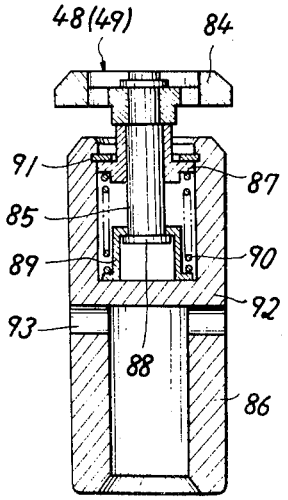

HYDRAULIC ACTUATING SYSTEM

BACKGROUND OF THE INVENTION

The present invention relates to generally an open-circuit hydraulic actuating system, and more particularly a hydraulic actuating system of the type especially adapted for use with the load whose direction is reversed during operation.

When the load, which is initially stationary, is accelerated to a desired speed which is maintained for a predetermined time so that the load may accomplish a desired work and then the load is decelerated and stopped stationary; that is, when it is desired to control the speed of the load when the direction of the load is reversed during operation, it is imperative that the acceleration stage or stroke may be shifted to the constant speed stage or stroke as immediately and smoothly as possible; that the constant speed stage or stroke may be shifted to the deceleration stage or stroke as immediately and smoothly as possible; and that the speed of the load must be maintained as constant as possible in the constant speed stage or stroke so that the smooth operation may be ensured; the hydraulic system may be made compact in size; and the operating efficiency may be improved. One of the well known hydraulic systems which may satisfy the above requirements is a closed circuit hydraulic system in which a variable displacement hydraulic pump and a fixed displacement hydraulic motor are intercommunicated through tow main circuits. The first advantages of the hydraulic system of the type described is that the speed of the load may be infinitestimally controlled, and the second advantage is that the maximum speed of the load may be easily controlled by controlling the discharge of the hydraulic pump. The third advantage is that the power loss in the deceleration stage or stroke is very small even when a relief valve is actuated. Therefore, one may consider that a closed circuit hydraulic actuating system consisting of a variable displacement hydraulic pump and a fixed displacement hydraulic motor could satisfy the above requirements, but this is not true. In the closed circuit hydraulic actuating system, the speed control and reversal in direction of the load must be accomplished by the hydraulic pump. Therefore the hydraulic pump must satisfy the following requirements (a) that the discharge may be infinitestimally controlled, (b) that the direction of the discharge may be freely selected or reversed; and (c) that it must produce the retarding force. In order to satisfy the above requirements, very expensive hydraulic pumps such as axial plunger pumps must be used, but result is the increase in the cost and the excessive noise in operation. Furthermore the zero-point control (that is, the control of the point at which the discharge is zero) of the hydraulic pump is extremely difficult so that it is difficult to bring the load completely stationary. Moreover, during the operation at a low speed with a small capacity, hunting phenomenon occurs in a flushing valve unit.

Therefore, it is very advantageous to provide an open circuit hydraulic actuating system which may substantially overcome the above defects and may control the speed of the load under the operating conditions described above. For this purpose, there has been proposed an open circuit hydraulic actuating system which consists of a fixed displacement pump, a hydraulic motor and a directional control valve. In this system, a flow control valve whose operation is controlled in response to the operation of the directional control valve is inserted between the directional control valve and the hydraulic motor for controlling the flow rate of the return flow from the hydraulic motor, thereby controlling the speed of the load. There has been also proposed an open circuit hydraulic actuating system in which a flow control valve whose operation is controlled in response with the operation of a flow control valve is inserted between a hydraulic pump and the directional control valve for controlling the flow rate of the hydraulic liquid to be supplied to the hydraulic motor, and a counter balance valve is inserted between the flow directional valve and the hydraulic motor for preventing the free running of the hydraulic motor. However, in both of the hydraulic systems of the type described above, the back pressure is generated at the discharge port of the hydraulic motor even in the accleration and constant speed stages or strokes in which the direction of the load is positive so that the circuit efficiency is comparatively low. Furthermore, unless the speed of the load rises in excess of the discharge of the hyraulic pump, the discharge pressure of the hydraulic pump rises to the set pressure of the main relief valve even when the load is less so that the power loss is considerably increased. Especially in the deceleration stage or stroke in which the direction of the load is negative, the pressure on the return or counter side rises to an excessively high level not only due to the pressure produced by the load but also due to the pressure on the supply side which rises to the set pressure of the main relief valve. Therefore, the withstanding pressure of the hydraulic equipment and pipe lines must be determined based upon this excessively high pressure level with the result of the inevitable increase in cost.

SUMMARY OF THE INVENTION

In view of the above, one of the objects of the present invention is provide an open circuit hydraulic actuating system which may effect the meter-in control in such a way that the load speed may be controlled by controlling the flow rate in the supply line without causing the back pressure in the return or discharge line when the direction of the load is positive, and which system may be automatically switched to the meter-out control system when the direction of the load is reversed to negative so that the flow rate in the discharge or return line is controlled to generate the back pressure therein to generate the retarding force acting upon the load the pressure in the supply line being reduced as much as possible in the meter-out flow control in which the direction of the load is negative, thereby preventing the abnormal rise of the pressure in the discharge or return line; that is the counter pressure of the load due to the pressure rise in the supply line and simultaneously maintaining effectively the circuit efficiency under the meter-out flow control.

To this end, briefly stated, the present invention provides an open circuit hydraulic actuating system characterized in that an amplifier valve assembly which may produce a main flow whose flow rate is amplified with respect to that of a pilot flow in proportion to the ratio of the opening area of a detector orifice inserted in a pilot flow passage to the opening area of a main orifice inserted in a main flow passage is hydraulically and operatively combined with a flow control valve for controlling the flow rate of the pilot supply flow, a flow control valve for controlling the flow rate of the pilot return flow, and a switching valve which is automatically shifted in response to the pressure difference between the pilot supply and return flow passages in such a way that one pilot flow passage having a pressure lower than that of the other pilot flow passage may be communicated through a low-pressure relief valve with a tank.

According to the present invetion, a fixed displacement hydraulic pump may be used in an open circuit hydraulic actuating system which is advantageous over the closed circuit systems from the standpoint of operation and cost. Furthermore, the meter-in or meter-out flow control may be automatically selected depending upon the direction of the load. Especially in the meter-out flow control in which the direction of the load is negative, the pilot supply line is communicated through the low-pressure relief valve with the tank so that the pressure in the supply line may be maintained at a low level and the counter pressure may be reduced to the minimum. Therefore, the economical withstanding pressure may be selected for the hydraulic equipment and other structual components.

The above and other objects, features and advantages of the present invention will become more apparent from the following description of some preferred embodiments thereof taken in conjunction with the accompanying drawing.

BRIEF DESCRIPTION OF THE DRAWING

FIG. 6 is a sectional view of a body section thereof;

FIG. 7 is a top view thereof;

FIG. 8 is a bottom view thereof;

FIG. 9 is a longitudinal sectional view taken along the line 9—9 of FIG. 6;

FIGS. 10 and 11 are sectional views taken along the lines 10—10 and 11—11 of FIG. 6, respectively;

FIG. 12 is a sectional view of an upper cover of the amplifer valve assembly shown in FIG. 3;

FIG. 13 is a top view thereof;

FIG. 14 is a bottom view thereof;

FIG. 15 is a sectional view of a lower cover of the amplifier valve assembly shown in FIG. 3;

FIG. 16 is a top view thereof;

FIG. 17 is a bottom view thereof;

FIG. 18 is a longitudinal sectional view of a valve spool of the amplifier valve assembly.

DESCRIPTION OF THE PREFERRED EMBODIMENTS

Figure 1:
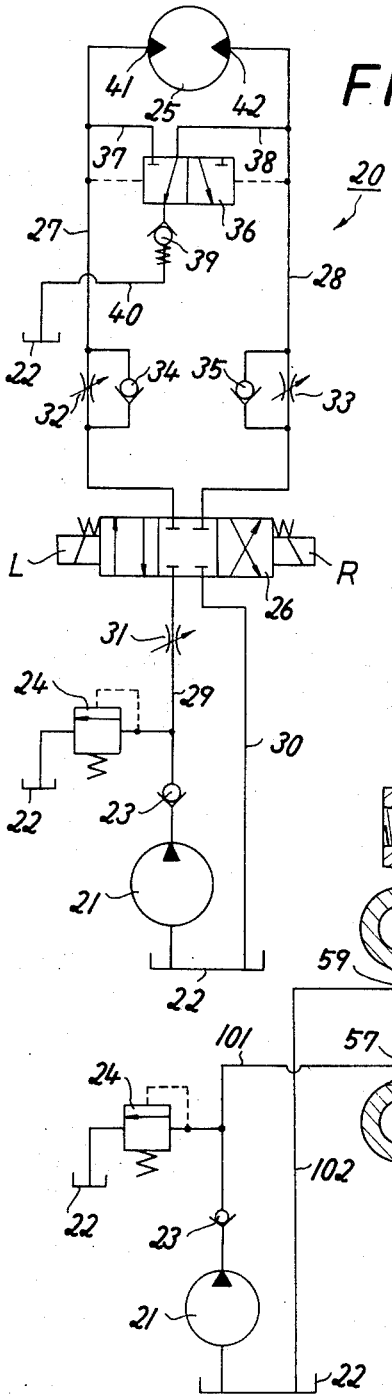
FIG. 1 is a fundamental hydraulic circuit diagram of an open circuit hydraulic actuating system in accordance with the present invention.

Fundamental Hydraulic Circuit, FIG. 1

In FIG. 1 there is shown a fundamental hydraulic circuit of a hydraulic actuating system in accord with the present invention generally indicated by the reference numeral 20 and adapted to control both the positive and negative loads. The hydraulic actuating system 20 comprises, in general, a hydraulic power source consisting of a hydraulic pump 21, a tank 22, a load check valve 23 and a main relief valve 24; and a hydraulic actuating circuit consisting of a hydraulic actuator 25 and a closed-center, four-port, three-position solenoid operated valve 26.

Two hydraulic lines 27 and 28 of the hydraulic actuator 25 are selectively communicated with a supply line 29 from the hydraulic pump 23 and with a discharge or return line 30 in communication with the tank 22 by the operation of the solenoid operated valve 26. A meter-in flow control valve 31 is inserted in the supply line 29, and meter-out flow control valve 32 and 33 are inserted in the line 27 and 28, respectively. Check valves 34 and 35 are inserted in parallel with the meter-out flow control valves 32 and 33, respectively. Between the lines 27 and 28 is inserted a switching valve 36 of the type which automatically detects the pressures in the lines 27 and 28 and communicates the low pressure line 27 or 28 through a line 37 or 38, a low-pressure relief valve 39 and a return line 40 with the tank 22.

When the solenoid L of the solenoid operated valve 26 is energized so that the solenoid operated valve 26 is shifted to the left position, the hydraulic liquid under pressure discharged from the hydraulic pump 21 flows through the supply line 29, the meter-in flow control valve 31, the solenoid operated valve 26, the check valve 34 and the line 27 into the left port 46 of the hydraulic actuator 25. The hydraulic liquid flows through the right port 42 of the hydraulic actuator 25, the line 28, the meter-out flow control valve 33, the solenoid operated valve 26, the return line 30 into the tank 22. As a result, the piston (not shown) of the hydraulic actuator 25 is displaced in the positive direction.

When the load is acting on the hydraulic actuator 25 in the positive direction, the load pressure is generated in the line 27 so that the hydraulic pressure in the line 27 becomes higher than that in the line 28. As a consequence, the switching valve 36 automatically shifts to the left position shown in FIG. 1 to communicate the line 28 through the low-pressure relief valve 39 and the line 40 with the tank 22. This arrangement makes it possible to set the flow rate of the meter-in flow control valve 31 inserted in the supply line 29 at a higher level than that of the meter-out control valve 33 inserted in the line 28. The reason is that the hydraulic liquid equal in quantity to the difference between the set flow rates of the meter-in flow control valve 31 and the meter-out flow control valve 33 flows from the line 28 through the switching valve 36 into the low-pressure relief valve, where the hydraulic liquid is maintained at a low pressure, and then through the line 40 into the tank 22 so that the meter-out flow control valve 33 is not actuated. Thus, the hydraulic actuator 25 in the actuating circuit is actuated at a speed which is determined under the meter-in flow control. In this case, the effective pressure difference between the ports of the hydraulic actuator 25 is controlled by the low-pressure relief valve 39 so that when the latter is set to as the minimum pressure as possible, the decrease in hydraulic circuit efficiency may be prevented.

When the load is acting on the hydraulic actuator 25 in the negative direction or when the direction of the load is reversed to the negative direction, the meter-out flow control valve 33 inserted in the line 28 is actuated to prevent the free running of the load because the hydraulic actuator 25 is operated under the meter-out flow control. That is, in the line 28 intercommunicating between the right port 42 of the hydraulic actuator 25 and the meter-out flow control valve 33 is generated the counter pressure which is higher than the pressure in the line 27. Therefore the switching valve 36 is automatically shifted to the right position so that the line 27 is communicated through the low-pressure relief valve 39 and the return line 40 with the tank 22. Consequently, the maximum pressure in the supply line 29 is controlled by the low-pressure relief valve 39 so that the hydraulic pressure in the supply line 27 may be maintained at a low pressure by the relief valve 39 without being raised to the maximum pressure set by the main relief valve 24 inserted in the supply line 29. This means not only that the hydraulic pressure in the line 28 to which are applied both the load pressure and the supply pressure under the meter-out flow control may be reduced to the minimum so that the economical design of the structual members which suffice to have the strength only sufficient to withstand a relatively low pressure becomes possible, but also that the effective pressure difference across the piston in the hydraulic actuator 25 may be increased with the result of the improvement of the hydraulic circuit efficiency. Furthermore, since the flow rate of the meter-in flow control valve 31 is set higher than that of the meter-out flow control valve 33, the negative pressure is positively prevented from being generated in the supply line 27. Thus, the hydraulic actuating circuit may be actuated with the optimum flow rate by the meter-out flow control valve 33.

The reverse of the hydraulic actuator 25 is effected by energizing the right solenoid R of the solenoid operated valve 26 so as to shift the latter to the right position. The hydraulic liquid discharged from the pump 21 flows through the supply line 29, the meter-in flow control valve 31, the solenoid operated valve 26, the check valve 35 and the line 28 into the right port 42 of the hydraulic actuator 25. The hydraulic liquid flows from the left port 41 through the line 27, the meter-out flow control valve 32, the solenoid operated valve 26, and the return valve 30 into the tank 22. Thus, the direction of the hydraulic liquid flow in the actuating circuit is opposite to that when the load is acting on the hydraulic cylinder 25 in the positive direction, and the actuating circuit is operating in a manner substantially similar to that described above except that the switching valve 36 is shifted to the meter-out flow control position and that the meter-out flow control is effected.

The hydraulic actuating system shown in FIG. 1 may employ an open circuit system which is advantageous in view of the operation and fabrication cost, and may effect the automatic switching between the meter-in and meter-out flow controls so that the effective load control may be attained.

From the above description, the features and advantages of the hydraulic actuating system may be well understood by those skilled in the art. However, there is a defect that the hydraulic actuating or control system of the type described becomes expensive when the system is applied to actuate or control a great load because the large-capacity flow control valves, switching valve and low-pressure relief valve must be provided accordingly.

Figure 2:
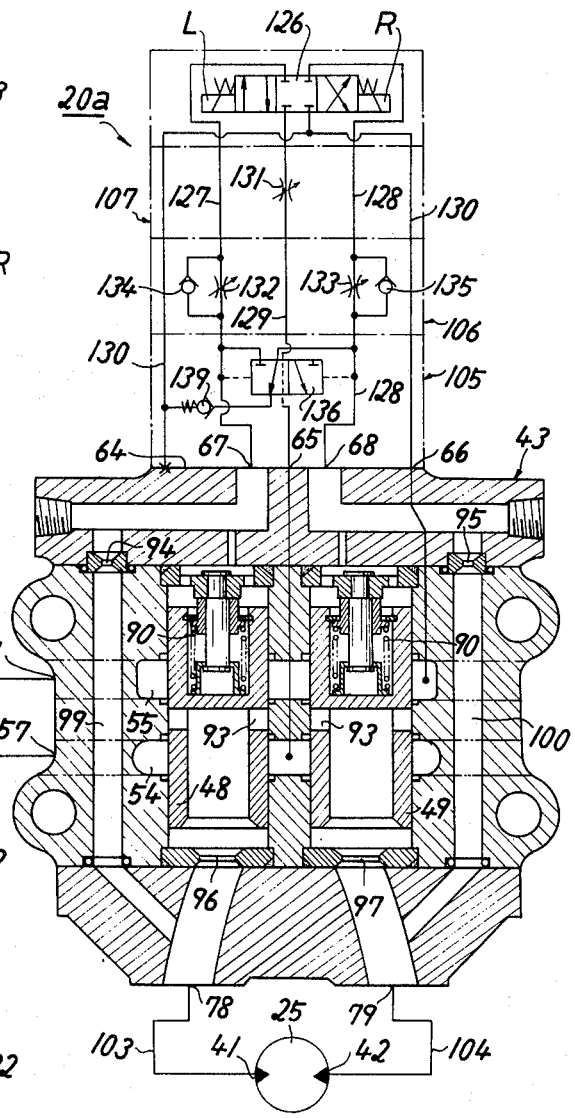
FIG. 2 is a hydraulic circuit diagram of a first embodiment of an open circuit hydraulic actuating system in accordance with the present invention adapted for use with a heavy load.

First Embodiment, FIG. 2

FIG. 2 shows a pressure responsive sequencing device 20*a* in accord with the present invention which may be fabricated at less cost. In the actuating circuit is inserted an amplifier valve assembly 43 which constitutes a hydraulic Wheaston bridge and controls the pilot flows as will be described in detail hereinafter.

Figure 3:
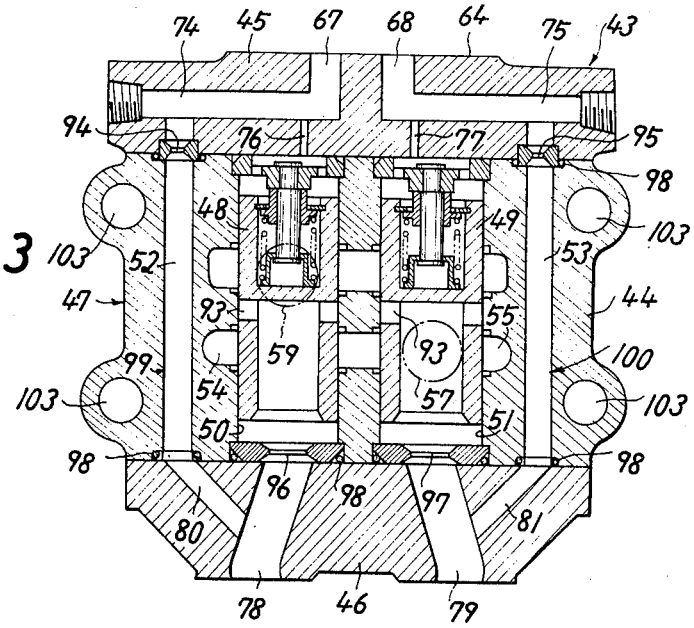
FIG. 3 is a longitudinal sectional view of an amplifier valve assembly thereof.
Figure 4:
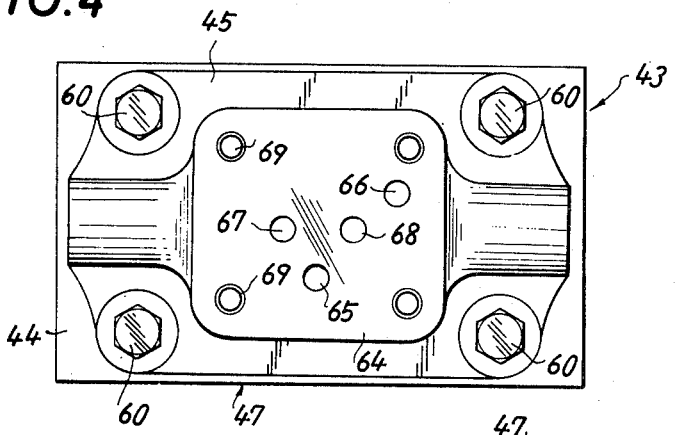
FIG. 4 is a top view thereof.
Figure 5:
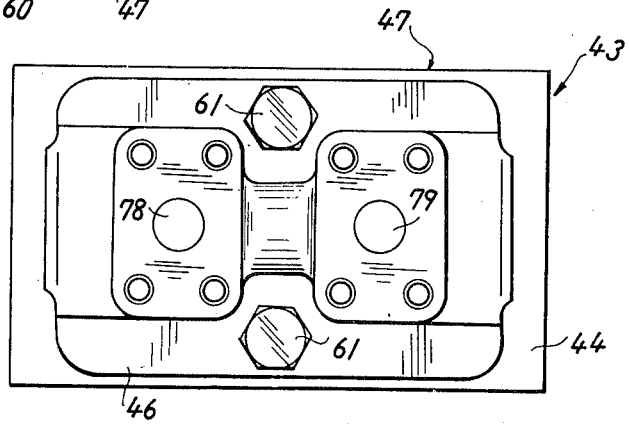
FIG. 5 is a bottom view thereof.

Amplifier Valve Assembly, FIGS. 3, 4 and 5

As shown in FIGS. 3, 4 and 5, the amplifier valve assembly 43 comprises a body member 47 consisting of a body section 44, an upper cover 45 and a lower cover 46, and valve spools 48 and 39 mounted in the body section 44.

Body Section 44, FIGS. 6, 7 and 8

As shown in FIG. 6 through 8, the body section 44 is provided with two valve chambers 50 and 51 and two passages 52 and 53 which are vertically extended in parallel with each other, two annular grooves 54 and 55 in communication with the valves chambers 50 and 51, a communication passage 56 in communication with ports 57 and the annular grrove 54 and a communication passage 58 in communication with ports 59 and the other annular groove 55. One end of each of the communication passages 56 and 58 is opened at the upper surface of the body section 44 while the other end terminates to the ports 57 or 59 opened at the side surface of the body section 44. As best shown in FIGS. 9 through 11, in order to facilitate the machining of the communication passages 56 and 58 and the ports 57 and 59, the annular grooves 54 and 55 are enlarged at 54*a* and 55*a* towards the ports 57 and 59. From the side surface of the body sections, the ports 57 and 59 are drilled to communicate with the enlarged portions 54*a* and 55*a*, respectively, and the communication passage 56 is drilled vertically from the upper surface of the body section 44 to communicate with the enlarged portion 54*a* of the lower annular groove 54. In like manner, the communication passage 58 is drilled at a small angle relative to the vertical from the top surface of the body section 44 so as to be communicated with the enlarged portion 55*a* of the upper annular groove 55. Furthermore, the body section 44 is provided with vertical through bolt holes 62 and 63 through which are extended through bolts 60 and 61 for assembling the body section 44 with the upper and lower covers 45 and 46 (See FIGS. 4 and 5).

Upper Cover, FIG. 12 through 14

As shown in FIGS. 12 through 14, the upper cover 45 has a mounting seat 64 formed on the top surface thereof, and a pilot intake port 65, a pilot discharge port 66, two pilot ports 67 and 68 and screw holes for attachment of a pilot valve are formed through the upper cover 45 at the mounting seat 64 thereof in alignment with the corresponding ports and screw holes of a standardized solenoid controlled valve. The upper cover 45 is further provided with bolt holes 70 and screw holes 71 in alignment with the corresponding holes 62 and 63 of the body section 44. When the upper cover 45 is attached to the body section 44, the intake port 65, the discharge port 66 and two pilot ports 67 and 68 are communicated with the communication passages 56 and 58 and the passages 52 and 53, respectively, of the body section 44 through passages 72, 73, 74 and 75, respectively, formed through the upper cofver 45. As best shown in FIG. 3, the passages 74 and 75 in communication with the pilot ports 67 and 68, respectively, are communicated through damper orifices 76 and 77, respectively, with the upper ends of the valve chambers 50 and 51, respectively, of the body section 44.

Lower Cover 46, FIGS. 15 through 17

As shown in FIGS. 15 through 17, the lower cover 46 is provided with two ports 78 and 79 extended through the lower cover 46, passages 80 and 81 which are branched from the ports 78 and 79, respectively, and opened at the upper surface of the upper cover 46, screw holes 82, and bolt holes 83 in alignment with the through holes 62 and 63 of the body section 44. When the lower cover 46 is attached to the main body section 44, the ports 78 and 79 are communicated with the lower ends of the valve chambers 50 and 51, respectively, of the body section 44 while the branched passage 80 and 81 are communicated with the passages 52 and 53, respectively, of the body section 44.

Valve Spool 48 and 49, FIG. 18

Since the valve spools 48 and 49 are identical in construction, only the valve spool 48 will be described. A guide rod 85 which is fitted into a spool body 86 has its upper end terminated into a bush 84 and its lower end terminated into a flange 88. A center spring 90 is loaded between an upper spring seat 77 fitted over the guide rod 85 and a lower spring seat 89 received by the flange 88 of the guide rod 85. The upper spring seat 87 is retained in position by a snap ring 91 fitted into the spool body 86, and the lower spring seat 89 is pressed against a partition wall 92 of the spool body 86 so that the bush 84 may be normally held in the predetermined relative position with respect to the spool body 86 under the force of the center sring 90. Passages 93 are formed through the side wall of the spool body 86 below the partition wall 92 thereof.

Amplifier Valve Assembly

Referring back to FIGS. 3 through 5, the valve spools 48 and 49 are inserted into the valve chambers 50 and 51, respectively, of the body section 44; orifices 94 and 95 are inserted into the passages 74 and 75, respectively, of the upper cover 45; and main orifices 96 and 97 are attached at the lower ends of the valve chambers 50 and 51. Packings 98 are inserted between the upper and lower covers 45 and 46 on the one hand and the body section 44 on the other hand, and the upper cover 45, the body section 45 and the lower cover 46 are assembled into a unitary construction with the through bolts 60 and 61. The ports 78 and 79 of the lower cover 46 are communicated through the main orifices 96 and 97, respectively, with the lower ends of the valve chambers 50 and 51, respectively, of the main body section 44, and the passages 74 and 75 of the upper cover 45 are communicated through the damper orifices 76 and 77, respectively, with the upper ends of the valve chambers 50 and 51, respectively. The pilot ports 67 and 68 of the upper cover 45 are communicated with the pilot ports 78 and 79, respectively, of the lower cover 46 through a pilot passage 99 made up of the passages 80, 52, and 74 and a pilot passage 100 made up of the 81, 53, 75. The ports 74 of the body section 44 are communicated through the lower annular groove 54, the passages 56 and 72 with the intake port 65 of the upper cover 45, and the ports 59 of the body section 44 are communicated through the upper annular groove 55 and the passages 58 and 73 with the discharge port 66 of the upper cover 45. The passages 93 of the valve spools 48 and 39 are located in the neutral position between the upper and lower annular grooves 55 and 54 as shown in FIG. 3.

Hydraulic Actauting System 20*a*, FIG. 2

Next referring back to FIG. 2, the hydraulic actuating system 20*a* incorporating the amplifier valve assembly 43 of the type described above will be described in more detail hereinafter.

One port 57 of the amplifier valve assembly 43 is communicated through a line 101 with the pump 21, and one port 59, the tank 22 through a line 102. In the instant embodiment, the other ports 57 and 59 are closed with plugs, but they may be communicated with the communication ports of another hydraulic circuit module. The ports 78 and 79 are communicated through lines 103 and 103 with the left and right ports 41 and 42, respectively, of the hydraulic cylinder 25.

Upon the mounting seat 64 of the amplifier assembly 43 are stacked a switching valve assembly 105, flow control valve assemblies 106 and 107 and a closed-center, four port, three-position solenoid operated valve 126, in the order named with the bolts inserted through the holes 69. The supply port 65 of the amplifier valve assembly 43 is communicated through a supply line 129 and a meter-in flow control valve 131 with a first port of the solenoid operated valve 126; the discharge port 66, through a return line 130 with a second port; and the pilot ports 67 and 68, with a third and fourth port, respectively, through lines 127 and 128 and meter-out flow control valves 132 and 133 in parallel of which are inserted check valves 134 and 135, respectively. Between the lines 127 and 128 is inserted a switching valve 136 which is substantially similar both in construction and operation to the switching valve 36 described with reference to FIG. 1 so that either of the lines 127 or 128 may be communicated through a low-pressure relief valve 139 with the return line 130.

When the solenoid operated valve 126 is kept de-energized as shown in FIG. 2, the hydraulic actuator 25 is deactivated because no hydraulic liquid flows through the actuating circuit. That is, the annular groove 54 is closed by the valve spools 48 and 49, and the communication between the pilot supply port 65 and the annular groove 54 is interrupted by the solenoid operated valve 126.

When the left solenoid L of the valve 126 is energized to shift the valve 126 to the left position, the pilot flow flows from the annular groove 54 in the amplifier valve assembly 43 through the port 65, the line 129, the meter-in flow control valve 131, the solenoid controlled valve 126, the line 127, the check valve 134 in parallel with the meter-out flow control valve 132, the pilot port 67, the pilot passage 99, the port 78 and the line 103 into the left port 41 of the hydraulic actuator 25. The return pilot flow flows from the right port 42 of the hydraulic actuator 25 through the line 104, the port 79, the pilot passage 100, the pilot port 68, the line 128, the meter-out flow control valve 133, the solenoid controlled valve 126, the return line 130, the return port 66, the annular groove 55, the port 59 and the line 102 into the tank 22. Therefore the hydraulic actuator 25 is actuated in the positive direction. In response to the pressure differences caused by the pilot flows across the detector orifices 94 and 95 inserted in the pilot passages 99 and 100, the valve spool 48 moves downwardly against the spring 90 while the right valve spool 49 moves upwardly against the spring 90. Then, the main supply flow flows from the annular groove 54 through the communication port 93 in the valve spool 48, the main orifice 96, the port 78 where the main supply flow joins the pilot supply flow, and the line 103 into the left port 41 of the hydraulic actuator 25. The main discharge or return flow flows from the right port 42 of the hydraulic cylinder 25 through the line 104, the port 79, the main orifice 97, the communication hole through the valve spool 49, the annular groove 55 where the main return flow joins the pilot return flow, the port 59 and the line 102 into the tank 22. The pressure differences across the main orifices 96 and 97, which are dependent upon the flow rates of the main supply and return flows, serve to cancel the pressure differences across the detector orifices 94 and 95 so that the valve spools 48 and 49 remain stationary at the position where the difference between the pressure difference across the main orifices 96 and 97 and the pressure differences between the detector orifices 94 and 95 is in equilibrium with the returning force of the base spring 90. The flow rate Q of the main flow is given by $$Q = A/a \cdot q$$

where

*A :* opening area of the main orifices 96 and 97;

*a :* opening area of the detector orifices 94 and 95; and

*q :* flow rate of the pilot flow.

Therefore, the hydraulic actuator 25 is actuated by the pilot flow with a relatively small flow rate and the main flow with the flow rate which is amplified with respect to the flow rate of the pilot flow. The right and left valve spools 48 and 49 move upwardly and downwadly so that the pressure of the main flow may become equal to the pressure of the pilot flow. That is, the opening area of the communication port 93 with respect to each of the annular grooves 54 and 55 may be automatically controlled.

When the load is acting in the positive direction on the hydraulic actuator 25, the meter-in flow control is effected. That is, the switching valve 136 is shifted to the left position so that the line 128 is communicated through the low-pressure relief valve 139 and the return line 130 with the tank 22. However, when the load is acting in the negative direction or the direction of the load is reversed from the positive to the negative direction, the hydraulic actuator 25 is actuated under the meter-out flow control. That is, the switching valve 136 is shifted to the right position so that the line 127 is communicated through the relief valve 139 with the return line 130. Thus, it is seen that the hydraulic actuating or control system 20*a* is operated in a manner substantially similar to that of the hydraulic system shown in FIG. 1.

The hydraulic actuator 25 is reversed by energizing the right solenoid R of the solenoid operated valve 126 to shift it to the right position.

As seen from FIG. 2, the hydraulic actuating system 20*a* is symmetrical so that when the solenoid operated valve 126 is shifted to the right position, the directions of the main and pilot flows are reversed. That is, the main supply flow flows from the annular groove 54 into the right port 42 of the hydraulic actuator 25, and the main return flow flows from the left port 41 through the annular groove 55 into the tank 22. Since the check valve 135 is inserted in parallel with the meter-out flow control valve 133, the meter-in flow control valve 131 and the meter-out flow control valve 132 are actuated so that the hydraulic actuator 25 is operated in the reverse direction in a manner substantially similar to that described hereinbefore.

As described hereinabove, in the hydraulic actuating system 20*a* shown in FIG. 2, depending upon the positive or negative direction of the load acting upon the actuating circuit, the pilot flows, whose flow rates are considerably less as compared with those of the main supply and return flows, are produced so that the meter-out or meter-in flow control is automatically effected so that the very efficient operation may be accomplished.

In the fundamental hydraulic circuit shown in FIG. 1 and the first embodiment shown in FIG. 2, the flow rate of the meter-in flow control valve must be set higher than that of the meter-out flow control valve in order to prevent the buildup of the negative pressure in the supply lines under the meter-out flow control. However, in case of the hydraulic cylinder the flow rates of the meter-in and meter-out flow control valves cannot be set in the manner described above from the standpoint of the control. Furthermore, in some cases the throttle valves are used as the meter-in and meter-out flow control valves.

Figure 19:
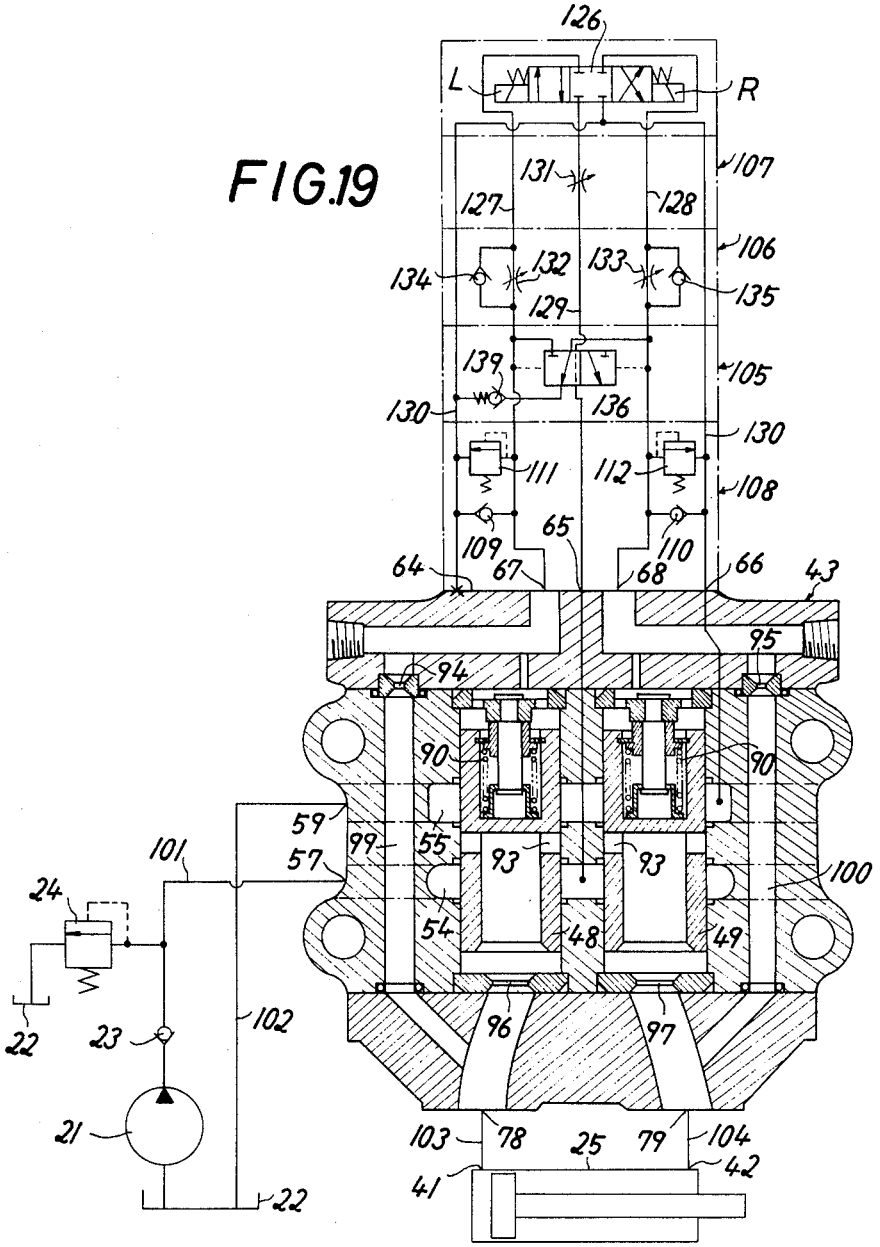
FIG. 19 is a hydraulic circuit diagram of a second embodiment of the present invention.

Second Embodiment, FIG. 19

In the latter two cases, as shown in FIG. 19, upon the mounting seat 64 of the amplifier valve assembly 43 are stacked an anticavitation valve assembly 108, the switching valve assembly 105, the flow control valve assemblies 106 and 107 and the solenoid operated valve 126, in the order named. Anticavitation valves 109 and 110 in the anticavitation valve assembly 108 are so arranged that the hydraulic liquid may be recirculated into the line 127 or 128. In the second embodiment, overload relief valves 111 and 112 are inserted in parallel with the anticavitation valves 109 and 110, respectively, to make up an overload circuit.

So far the present invention has been described with refrence to the preferred embodiments thereof, but it is to be understood that various modifications can be effected without departing the true spirit and scope of the present invention as indicated in the appended claims.

What is claimed is:

1. A hydraulic actuating system, comprising a hydrulic actuator having a fluid intake port and a fluid discharge port;

first means forming a fluid supply line which communicates with said intake port of said hydraulic actuator;

second means forming a fluid discharge line which communicates with said discharge port of said hydraulic actuator;

a fluid reservoir;

pump means for supplying fluid under pressure from said reservoir to said fluid supply line;

a closed center control valve interposed in said fluid supply and said fluid discharge lines;

an adjustable inflow control valve in said fluid supply line upstream of said intake port for controlling the rate of fluid flow into said intake port;

an adjustable outflow control valve in said fluid discharge line downstream of said discharge port for controlling the rate of fluid outflow from said outflow port;

two position switching value means communicating with said fluid lines intermediate said hydraulic actuator and said control valves for detecting a pressure difference between said fluid lines which results from a difference between the fluid requirements of said hydraulic actuator and fluid flow rate permitted by said control valves, and for communicating that one of said fluid lines which has the lower detected pressure with said reservoir via a low pressure relief valve so as to prevent excessive pressure build-up in the respective lines; and an amplifier valve assembly intermediate said hydraulic actuator and said control valves and including a housing having two valve chambers each interposed in parallel with one of said fluid lines and having inner circumferential surfaces formed with respective inlet and exhaust annular grooves connected directly to swaid fluid reservoir and said pump means, port means each communicating with one of said fluid lines and one end of said valve chamber, a pair of hollow inlet and exhaust valve spools each slidable in one of said chabers between positions in which it respectively permits and prevents fluid flow through the other end of the respective chamber to the respective fluid line to join with the fluid flow in the respective fluid line from said closed center control valve, and wherein said control means form differential pressure-detecting pilot-flow circuit means for controlling the extent of movement of said valve spools between said positions thereof in dependence upon the detected pressure difference between said fluid lines.

2. A hydraulic actuating system as defined in claim 1, wherein said pilot-flow circuit means comprise two parallel pilot passages provided in said housing and each having one end communicating with one of said fluid lines intermediate said amplifier valve assembly and said control valves and another end communicating with the same one of said fluid lines intermediate a respective one of said valve chambers and said hydraulic actuator.

3. A hydraulic actuating system as defined in claim 2, said pilot-flow circuit means further comprising a pair of detecting orifices each inserted in one of said pilot passages adjacent said one end thereof.

4. A hydraulic actuating system as defined in claim 3, wherein said valve spools ar tubular members axially slidable in the respective valve chambers and each having a circumferential wall provided with openings which are adapted to communicate respective ones of said annular grooves with the interior of said valve spools in dependence upon the movement of said valve spools between said positions thereof.

* * * * *